US010422135B1

(12) United States Patent
Penhallegon et al.

(10) Patent No.: US 10,422,135 B1
(45) Date of Patent: Sep. 24, 2019

(54) BARRIER SYSTEM

(76) Inventors: Michael Penhallegon, Largo, FL (US); Gregory May, Largo, FL (US)

( * ) Notice: Subject to any disclaimer, the term of this patent is extended or adjusted under 35 U.S.C. 154(b) by 0 days.

(21) Appl. No.: 12/930,904

(22) Filed: Jan. 19, 2011

Related U.S. Application Data

(60) Provisional application No. 61/456,283, filed on Nov. 4, 2010.

(51) Int. Cl.
*E04C 2/38* (2006.01)
*E04C 2/54* (2006.01)

(52) U.S. Cl.
CPC ..... *E04C 2/54* (2013.01)

(58) Field of Classification Search
USPC ..... 52/656.2, 204.71, 171.1, 202; 160/371
See application file for complete search history.

(56) References Cited

U.S. PATENT DOCUMENTS

| | | | | |
|---|---|---|---|---|
| 2,377,449 | A * | 6/1945 | Prevette | 160/106 |
| 5,603,190 | A * | 2/1997 | Sanford | 52/202 |
| 7,387,151 | B1 * | 6/2008 | Payne | 160/371 |
| 7,975,440 | B2 * | 7/2011 | Motosko et al. | 52/202 |

* cited by examiner

*Primary Examiner* — Basil Katcheves

(57) ABSTRACT

An open barrier frame in an inverted U-shaped configuration has an upper horizontal and two laterally spaced vertical segments. The segment has an interiorly facing indentation with a width and a thickness. A lower closure segment with lateral ends is coupled to the vertical segments. The closure segment has a generally rectangular cross sectional configuration with a vertical slot. In this manner the barrier frame creates a rectangular channel. A panel insert has a width and a thickness essentially equal to the width and thickness of the U-shaped indentation. The panel insert has an upper edge extending into the indentation of the horizontal segment. The panel has a lower edge extending into the slot of the closure segment and terminating at an intermediate elevation of the slot.

3 Claims, 3 Drawing Sheets

FIG. 1
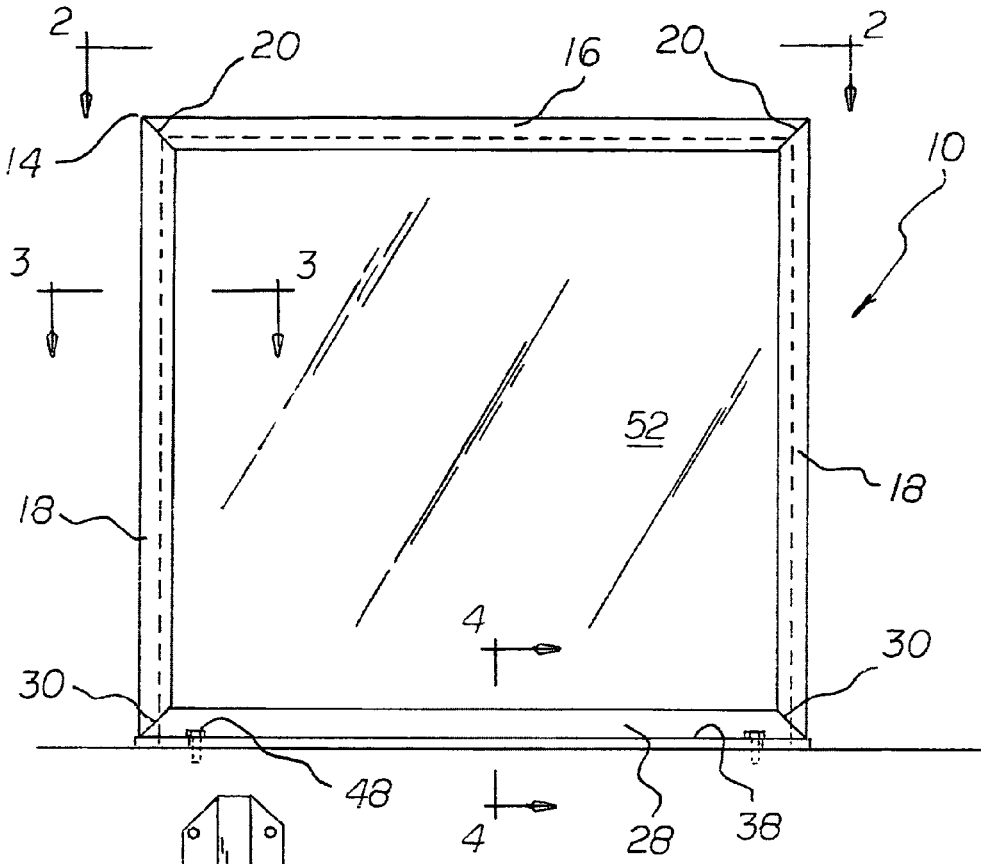
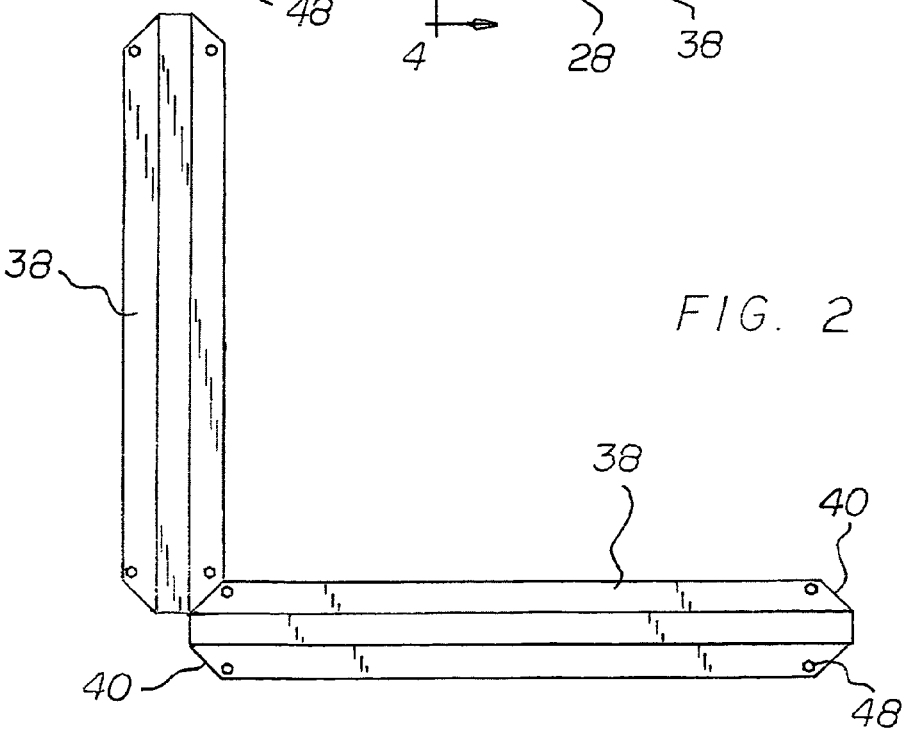
FIG. 2

FIG. 3
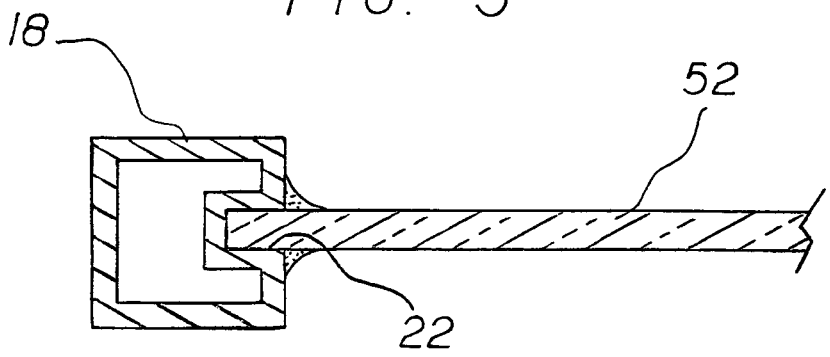
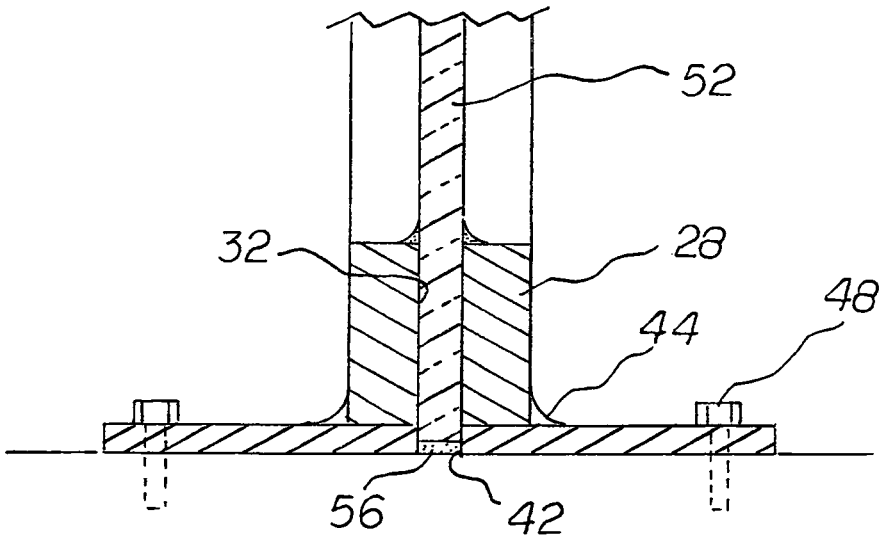
FIG. 4

BARRIER SYSTEM

RELATED APPLICATION

The present non provisional patent application is a continuation-in-part application of provisional application Ser. No. 61/456,283 filed Nov. 4, 2010, the subject matter of which is incorporated herein by reference.

BACKGROUND OF THE INVENTION

Field of the Invention

The present invention relates to a barrier system and more particularly pertains to controlling the location and movement of people such as travelers moving through airports, the controlling being achieved in a safe, secure, convenient and economical manner.

SUMMARY OF THE INVENTION

In view of the disadvantages inherent in the known types of barrier systems of known designs and configurations now present in the prior art, the present invention provides an improved barrier system. As such, the general purpose of the present invention, which will be described subsequently in greater detail, is to provide a new and improved barrier system and method which has all the advantages of the prior art and none of the disadvantages.

To attain this, the present invention essentially comprises a barrier system. First provided is an open barrier frame. The barrier frame is configured in an inverted U-shaped configuration. The barrier frame has an upper horizontal segment. The barrier frame has two laterally spaced vertical segments. The horizontal segment has 45 degree chamfered lateral ends. The vertical segments having 45 degree chamfered upper ends. The vertical segments have 45 degree chamfered lower ends. Upper weldments are provided. The upper weldments couple the lateral ends of the horizontal segment to the upper ends of the vertical segments. Each horizontal and vertical segment has a generally rectangular cross sectional configuration. Each horizontal and vertical segment has an interiorly facing C-shaped indentation. In this manner the barrier frame creates an inverted U-shaped channel. The horizontal and vertical segments are fabricated of extruded aluminum.

A lower closure segment is provided. The lower closure segment is configured in a linear configuration. The lower closure segment has 45 degree chamfered lateral ends. Lower weldments are provided. The lower weldments couple the lateral ends of the closure segment to the lower ends of the vertical segments. The closure segment has a generally rectangular cross sectional configuration. The closure segment has a vertical slot. The vertical slot is aligned with the indentations of the horizontal and vertical segments. In this manner the barrier frame creates a rectangular channel. The rectangular channel has a height and a width and a thickness. The closure segment is fabricated of extruded aluminum.

Provided next is a barrier base. The barrier base is in an octagonal configuration. The barrier base has two parallel length edges. The barrier base has two parallel width edges. The barrier base has four similarly configured 45 degree angled edges. The 45 degree angled edges are provided between the length and width edges. The barrier base has a length. The length of the barrier base is essentially equal to the length of the closure segment. The barrier base is adapted to be supported upon a recipient surface. The recipient surface is chosen from the class of recipient surfaces. The class of recipient surfaces includes carpets, tiles, concrete and any of a plurality of recipient floor surfaces. The barrier base has a length and a width. The length of the barrier base is between 5 and 10 times the width. The barrier base has four obtuse angles at the junction of the length edges and the angled edges. The barrier base has an aperture. The aperture extends through the barrier base at each obtuse angle. Base weldments are provided. The base weldments couple the closure segment to the barrier base. The width edges and the angled edges are of the same length. In this manner the positioning of a plurality of systems being deployed in contact with adjacent systems is facilitated. Note FIG. 2. The barrier base is fabricated of aluminum.

Four properly positioned screws are provided. The screws extend through the barrier base. In this manner securement and exact positioning of the barrier base to the recipient surface is allowed.

Further provided is a panel insert. The panel insert is fabricated of a clear shatterproof, scratch resistant acrylic for superior operational characteristics. The panel insert has a width and a thickness essentially equal to the width and thickness of the U-shaped indent. The panel has an upper edge. The upper edge of the panel extends into the indentation of the horizontal segment. The panel has a lower edge. The lower edge of the panel extends into the slot of the closure segment. The lower edge of the panel terminates at an intermediate elevation of the slot.

Provided last is a panel insert coupler. The panel insert coupler is provided between the panel insert and the segments of the barrier frame. A barrier base coupler is provided. The barrier base coupler is located in the slot between the barrier base and the panel insert. The barrier base coupler is adapted to provide a mechanical and adhesive coupler between the barrier frame and the panel insert. Note is taken of the slot which extends through a lower section of the barrier frame component and the barrier base to facilitate sliding the panel insert into the barrier frame while inverted. Thereafter, the barrier base coupler forms an adhesive strip in contact with the panel insert and the barrier base for an adhesive coupling. The system is subsequently inverted and positioned for use with the barrier base and the adhesive strip upon the recipient floor surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved barrier system which has all of the advantages of the prior art barrier systems of known designs and configurations and none of the disadvantages.

It is another object of the present invention to provide a new and improved barrier system which may be easily and efficiently manufactured and marketed.

It is further object of the present invention to provide a new and improved barrier system which is of durable and reliable constructions.

An even further object of the present invention is to provide a new and improved barrier system which is susceptible of a low cost of manufacture with regard to both materials and labor, and which accordingly is then susceptible of low prices of sale to the consuming public, thereby making such barrier system economically available to the buying public.

Even still another object of the present invention is to provide a barrier system for controlling the location and movement of people such as travelers moving through airports, the controlling being achieved in a safe, secure, convenient and economical manner.

Lastly, it is an object of the present invention to provide a new and improved barrier system. An open barrier frame in an inverted U-shaped configuration has an upper horizontal and two laterally spaced vertical segments. The segment has an interiorly facing indentation with a width and a thickness. A lower closure segment with lateral ends is coupled to the vertical segments. The closure segment has a generally rectangular cross sectional configuration with a vertical slot. In this manner the barrier frame creates a rectangular channel. A panel insert has a width and a thickness essentially equal to the width and thickness of the U-shaped indentation. The panel insert has an upper edge extending into the indentation of the horizontal segment. The panel has a lower edge extending into the slot of the closure segment and terminating at an intermediate elevation of the slot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a barrier system constructed in accordance with the principles of the present invention.

FIG. 2 is a plan view of the system taken along line 2-2 of FIG. 1.

FIG. 3 is a cross sectional view taken along line 3-3 of FIG. 1.

FIG. 4 is a cross sectional view taken along line 4-4 of FIG. 1.

The same reference numerals refer to the same parts throughout the various Figures.

DESCRIPTION OF THE PREFERRED EMBODIMENT

Figure 5:
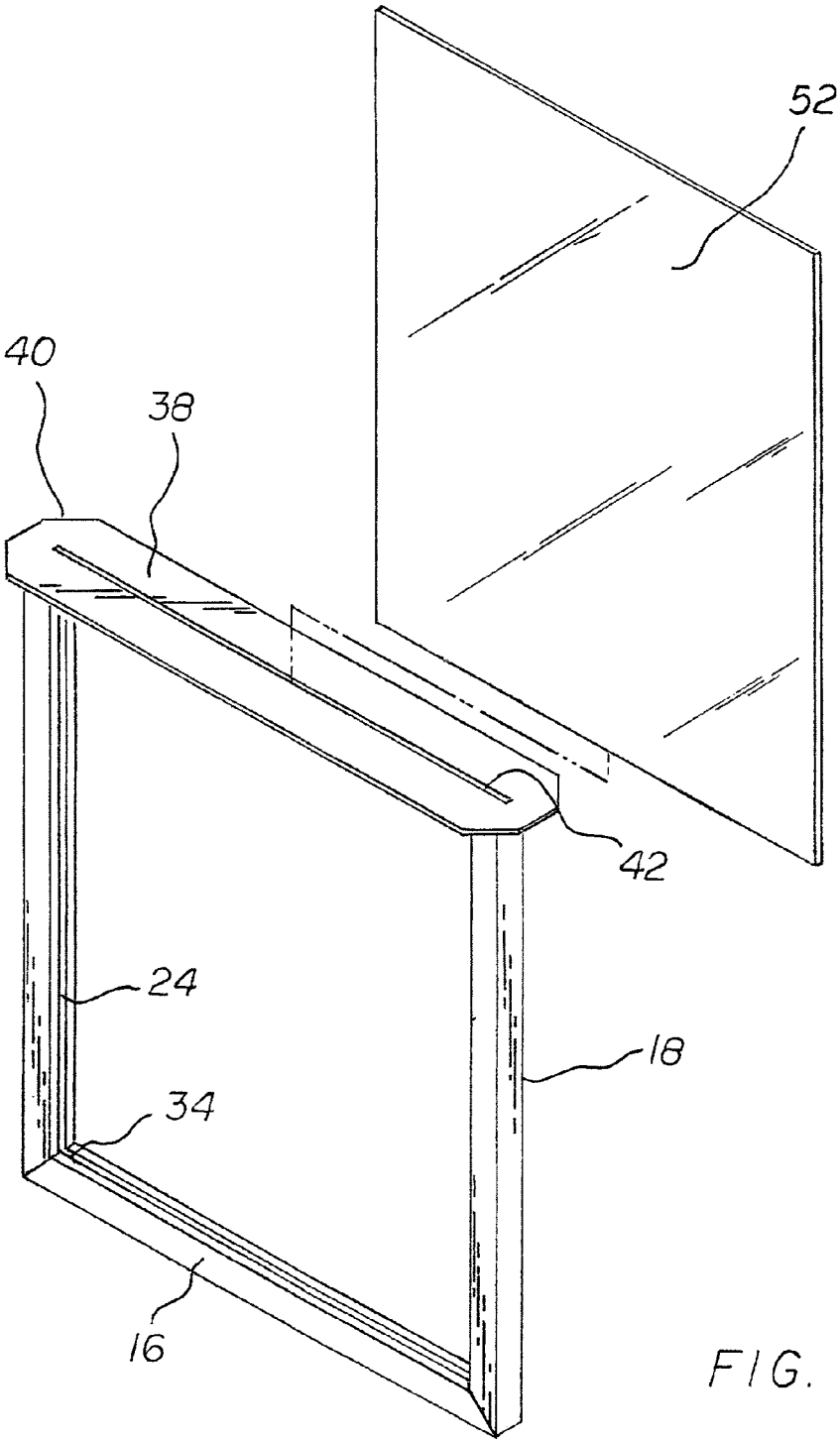
FIG. 5 is an exploded perspective illustration of the system of the prior Figures with the system in an inverted orientation prior to deployment.

With reference now to the drawings, and in particular to FIG. 1 thereof, the preferred embodiment of the new and improved barrier system embodying the principles and concepts of the present invention and generally designated by the reference numeral 10 will be described.

The present invention, the barrier system 10 is comprised of a plurality of components. Such components in their broadest context include an open barrier frame, a lower closure segment and a panel insert. Such components are individually configured and correlated with respect to each other so as to attain the desired objective.

First provided is an open barrier frame 14. The barrier frame is configured in an inverted U-shaped configuration. The barrier frame has an upper horizontal segment 16. The barrier frame has two laterally spaced vertical segments 18. The horizontal segment has 45 degree chamfered lateral ends. The vertical segments having 45 degree chamfered upper ends. The vertical segments have 45 degree chamfered lower ends. Upper weldments 20 are provided. The upper weldments couple the lateral ends of the horizontal segment to the upper ends of the vertical segments. Each horizontal and vertical segment has a generally rectangular cross sectional configuration. Each horizontal and vertical segment has an interiorly facing C-shaped indentation 22. In this manner the barrier frame creates an inverted U-shaped channel 24. The horizontal and vertical segments are fabricated of extruded aluminum.

A lower closure segment 28 is provided. The lower closure segment is configured in a linear configuration. The lower closure segment has 45 degree chamfered lateral ends. Lower weldments 30 are provided. The lower weldments couple the lateral ends of the closure segment to the lower ends of the vertical segments. The closure segment has a generally rectangular cross sectional configuration. The closure segment has a vertical slot 32. The vertical slot is aligned with the indentations of the horizontal and vertical segments. In this manner the barrier frame creates a rectangular channel 34. The rectangular channel has a height and a width and a thickness. The closure segment is fabricated of extruded aluminum.

Provided next is a barrier base 38. The barrier base is in an octagonal configuration. The barrier base has two parallel length edges. The barrier base has two parallel width edges. The barrier base has four similarly configured 45 degree angled edges 40. The 45 degree angled edges are provided between the length and width edges. The barrier base has a length. The length of the barrier base is essentially equal to the length of the closure segment. The barrier base is adapted to be supported upon a recipient surface. The recipient surface is chosen from the class of recipient surfaces. The class of recipient surfaces includes carpets, tiles, concrete and any of a plurality of recipient floor surfaces. The barrier base has a length and a width. The length of the barrier base is between 5 and 10 times the width. The barrier base has four obtuse angles at the junction of the length edges and the angled edges. The barrier base has an aperture 42. The aperture extends through the barrier base at each obtuse angle. Base weldments 44 are provided. The base weldments couple the closure segment to the barrier base. The width edges and the angled edges are of the same length. In this manner the positioning of a plurality of systems being deployed in contact with adjacent systems is facilitated. Note FIG. 2. The barrier base is fabricated of aluminum.

Four properly positioned screws 48 are provided. The screws extend through the barrier base. In this manner securement and exact positioning of the barrier base to the recipient surface is allowed.

Further provided is a panel insert 52. The panel insert is fabricated of a clear shatterproof, scratch resistant acrylic for superior operational characteristics. The panel insert has a width and a thickness essentially equal to the width and thickness of the U-shaped indent. The panel has an upper edge. The upper edge of the panel extends into the indentation of the horizontal segment. The panel has a lower edge. The lower edge of the panel extends into the slot of the closure segment. The lower edge of the panel terminates at an intermediate elevation of the slot.

Provided last is a panel insert coupler 56. The panel insert coupler is provided between the panel insert and the segments of the barrier frame. A barrier base coupler 58 is provided. The barrier base coupler is located in the slot between the barrier base and the panel insert. The barrier base coupler is adapted to provide a mechanical and adhesive coupler between the barrier frame and the panel insert. Note is taken of the slot which extends through a lower section of the barrier frame component and the barrier base to facilitate sliding the panel insert into the barrier frame while inverted. Thereafter, the barrier base coupler forms an adhesive strip in contact with the panel insert and the barrier base for an adhesive coupling. The system is subsequently inverted and positioned for use with the barrier base and the adhesive strip upon the recipient floor surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A barrier system for controlling the location and movement of people such as travelers moving through airports comprising:

an open barrier frame in an inverted U-shaped configuration with an upper horizontal and two laterally spaced vertical segments, the upper horizontal and two laterally spaced vertical segments each having an interiorly facing indentation with a width and a thickness;

a lower closure segment with lateral ends coupled to the vertical segments, the closure segment having a generally rectangular cross sectional configuration with a vertical slot whereby the barrier frame creates a rectangular channel; and a panel insert having a width and a thickness essentially equal to the width and thickness of the U-shaped indentation, the panel insert having an upper edge extending into the indentation of the horizontal segment, the panel having a lower edge extending into the slot of the closure segment and terminating at an intermediate elevation of the slot; and a barrier base having a length essentially equal to the length of the closure segment, the barrier base receiving and supporting the closure segment, the barrier base having a slit the same size as the slot of the closure segment, the barrier base adapted to be supported upon a recipient surface, the segments and the barrier base being fabricated of aluminum, the panel insert being fabricated of clear shatterproof, scratch resistant acrylic.

2. A barrier system comprising:

an open barrier frame in an inverted U-shaped configuration with an upper horizontal and two laterally spaced vertical segments, the upper horizontal and two laterally spaced vertical segments each having an interiorly facing indentation with a width and a thickness;

a lower closure segment with lateral ends coupled to the vertical segments, the closure segment having a generally rectangular cross sectional configuration with a vertical slot whereby the barrier frame creates a rectangular channel;

a panel insert having a width and a thickness essentially equal to the width and thickness of the U-shaped indentation, the panel insert having an upper edge extending into the indentation of the horizontal segment, the panel having a lower edge extending into the slot of the closure segment and terminating at an intermediate elevation of the slot; and a panel insert coupler between the panel insert and the segments of the barrier frame, a barrier base coupler located in the slot between the barrier base and the panel insert adapted to provide a mechanical and adhesive coupling between the barrier frame and the panel insert.

3. A barrier system (10) for controlling the location and movement of people such as travelers moving through airports, the controlling being achieved in a safe, secure, convenient and economical manner, the system comprising, in combination:

an open barrier frame (14) configured in an inverted U-shaped configuration with an upper horizontal segment (16) and two laterally spaced vertical segments (18), the horizontal segment having 45 degree chamfered lateral ends, the vertical segments having 45 degree chamfered upper ends and 45 degree chamfered lower ends, upper weldments (20) coupling the lateral ends of the horizontal segment to the upper ends of the vertical segments, each horizontal and vertical segment having a generally rectangular cross sectional configuration with an interiorly facing C-shaped indentation (22) whereby the barrier frame creates an inverted U-shaped channel (24), the horizontal and vertical segments being fabricated of extruded aluminum;

a lower closure segment (28) configured in a linear configuration with 45 degree chamfered lateral ends, lower weldments (30) coupling the lateral ends of the closure segment to the lower ends of the vertical segments, the closure segment having a generally rectangular cross sectional configuration with a vertical slot (32) aligned with the indentations of the horizontal and vertical segments whereby the barrier frame creates a rectangular channel (34), the rectangular channel having a height and a width and a thickness, the closure segment being fabricated of extruded aluminum;

a barrier base (38) in an octagonal configuration with two parallel length edges and two parallel width edges and four similarly configured 45 degree angled edges (40) between the length and width edges, the barrier base having a length essentially equal to the length of the closure segment, the barrier base adapted to be supported upon a recipient surface chosen from the class of recipient surfaces including carpets, tiles, concrete and any of a plurality of recipient floor surfaces, the barrier base having a length and a width, the length being between 5 and 10 times the width, the barrier base having four obtuse angles at the junction of the length edges and the angled edges, an aperture (42) extending through the barrier base at each obtuse angle, base weldments (44) coupling the closure segment to the barrier base, the width edges and the angled edges being of the same length to facilitate the positioning of a plurality of systems being deployed in contact with adjacent systems, the barrier base being fabricated of aluminum;

four properly positioned screws (48) extending through the barrier base to allow for secure and exact positioning of the barrier base to the recipient surface;

a panel insert (52) fabricated of a clear shatterproof, scratch resistant acrylic for superior operational characteristics, the panel insert having a width and a thickness essentially equal to the width and thickness of the U-shaped indent, the panel having an upper edge extending into the indentation of the horizontal segment, the panel having a lower edge extending into the slot of the closure segment and terminating at an intermediate elevation of the slot;

a panel insert coupler (56) between the panel insert and the segments of the barrier frame, a barrier base coupler (58) located in the slot between the barrier base and the panel insert adapted to provide a mechanical and adhesive coupler between the barrier frame and the panel insert.

* * * * *